United States Patent [19]

Du Broff et al.

[11] 4,412,841

[45] Nov. 1, 1983

[54] COMPACTED CARBONACEOUS SHAPES AND PROCESS FOR MAKING THE SAME

[75] Inventors: William Du Broff, Munster; George H. Craig, La Porte; Timothy A. Veslocki, Highland, all of Ind.

[73] Assignee: Inland Steel Company, Chicago, Ill.

[21] Appl. No.: 278,056

[22] Filed: Jun. 29, 1981

[51] Int. Cl.[3] ..... C10B 19/00; C10B 53/08; C10B 57/06; C10L 5/28

[52] U.S. Cl. ..... 44/10 C; 201/6; 201/17; 201/19; 201/20

[58] Field of Search ..... 201/6, 17, 19, 20, 22, 201/41; 44/10 C, 11, 12, 1 F; 48/65, 197 R

[56] References Cited

U.S. PATENT DOCUMENTS

| | | | |
|---|---|---|---|
| 1,601,212 | 9/1926 | Henry | 201/19 |
| 2,068,448 | 1/1937 | Cox | 201/19 |
| 3,009,863 | 11/1961 | Angevine | 201/6 |
| 3,140,242 | 7/1964 | Work et al. | 201/17 |
| 3,449,213 | 6/1969 | Knapp et al. | 201/19 |
| 3,560,347 | 2/1971 | Knapp et al. | 202/108 |
| 3,843,457 | 10/1974 | Grannen et al. | 201/19 |
| 3,933,596 | 1/1976 | Long et al. | 201/17 |
| 3,954,674 | 5/1976 | Reis | 201/17 |
| 4,097,245 | 6/1978 | Holowaty | 201/6 |
| 4,111,755 | 9/1978 | Ban et al. | 201/17 |
| 4,282,066 | 8/1981 | Wagener et al. | 201/6 |

FOREIGN PATENT DOCUMENTS

| | | |
|---|---|---|
| 2017744 | 10/1979 | United Kingdom . |
| 2018813 | 10/1979 | United Kingdom . |

*Primary Examiner*—Bradley Garris

*Attorney, Agent, or Firm*—Merriam, Marshall & Bicknell

[57] ABSTRACT

Compacted carbonaceous shapes are produced by mixing a particulate carbonaceous material with a binder, forming green shapes from the mixture, and heating the green shapes by induction heating or microwave heating or a combination thereof. The process is particularly adapted for making formcoke.

16 Claims, 5 Drawing Figures

FIG. 1
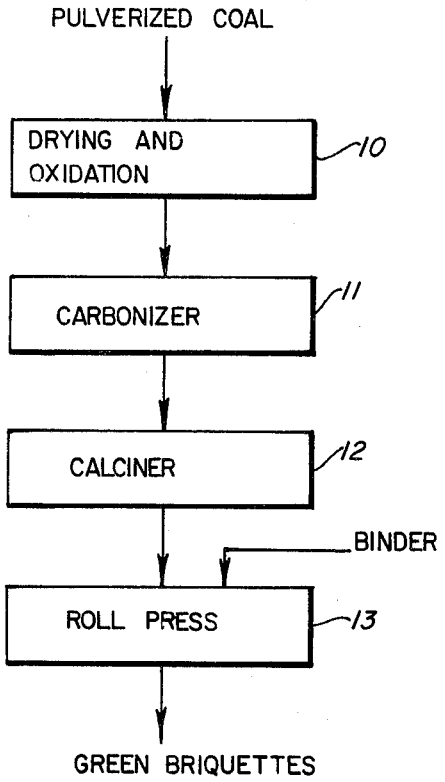
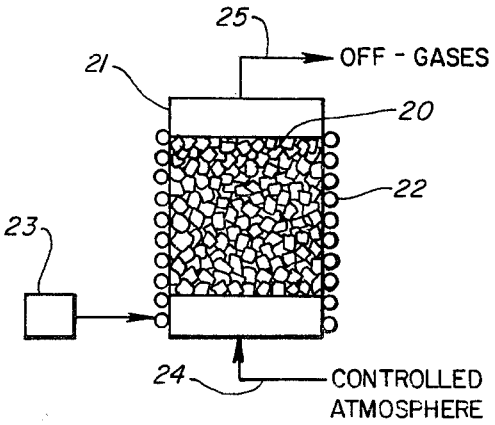
FIG. 2
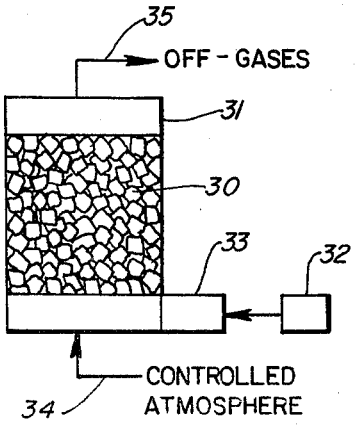
FIG. 3

COMPACTED CARBONACEOUS SHAPES AND PROCESS FOR MAKING THE SAME

This invention relates to improvements in compacted carbonaceous masses or shapes and to an improved process of making the same by the use of electromagnetic energy, particularly by induction heating or microwave heating or a combination of both.

It is broadly old in the art to produce compacted carbonaceous masses or shapes by (1) mixing particulate carbonaceous material, such as coke, carbonized coal, or char, with a suitable binder, such as coal tar or pitch, (2) forming the mixture into shapes, and (3) heat treating the preformed shapes. The resultant products may be used as fuels or for a wide variety of industrial uses for which baked carbon or graphitized products are particularly suited. Although the invention is described hereinafter with particular reference to the production of so-called formcoke as used in the steel industry, it is to be understood that the invention in its broadest aspect is not limited to any particular end use of the product.

The term "formcoke" (also "formed coke") is applied to coke which is obtained by calcination of preformed or preshaped carbonaceous solids. The term is used to distinguish from coke obtained as broken pieces of all sizes and shapes obtained from conventional by-product coke ovens. Although the procedure may vary somewhat, a typical formcoke process comprises the following steps: (1) pulverized coal is dried and partially oxidized with steam and air in a fluidized bed reactor; (2) the resultant product is carbonized at a relatively low temperature, e.g., about 480° C. (900° F.), to remove volatile matter, including tar which is recovered; (3) the resultant char is calcined at a relatively high temperature, e.g., about 815° C. (1500° F.); (4) the calcined char is cooled and blended with a suitable binder, such as the tar recovered in the low temperature carbonization step; (5) the blend or mixture is compacted to form green briquettes or the like in a roll press or other suitable equipment; (6) the green briquettes are heat cured, e.g., by heating to 200°–260° C. (390°–500° F.) for 1½ to 3 hours, in order to remove volatile material and to impart sufficient mechanical strength to the shapes to permit the handling required in subsequent processing; and (7) the cured briquettes are then coked, e.g., by heating to 790°–2200° C. (1450°–4000° F.) for a sufficient time to produce formcoke of metallurgical quality or other carbonaceous shapes that have suitable properties for the intended application.

The thermal processing of the green briquettes in a formcoke process has been accomplished in the past by means of conventional thermal processing using hot gases or burner flames. Thermal processing, however, is the major variable which affects the development of the desired strength and chemical reactivity in the final formcoke product for a given blend and compaction practice. The objective is to control the number, size, and distribution of pores and cracks in the formcoke product. The presence or absence of pores and cracks is one measure of the degree of carbon bonding effected during the thermal process and may also be a measure of crystallinity or degree of graphitization of the carbonaceous material. Improper control of time, temperature, and heating rate during thermal processing of the green briquettes can result in the formation of pores and cracks by thermally induced stresses and internal pressure due to excessively rapid elimination of volatile matter.

Microstructural examination of a typical commercially available formcoke reveals a significant concentration of pores and cracks in the vicinity of the surface relative to the interior. Such microstructure indicates that the interior of the briquette received an adequate thermal treatment but that the surface of the briquette was subjected to an excessive temperature or heating rate which produced a relatively steep thermal gradient, resulting in the formation of two or more different microstructural regions. The microstructure of the briquettes is the basis for the acceptable mechanical strength but unacceptable surface abrasion characteristics of commercially available formcoke. The poor surface abrasion characteristics are responsible for excessive dusting problems during use of the formcoke and can also result in degradation of the surface during storage as a result of alternate freezing and thawing.

While it is theoretically possible to reduce the heating rate and avoid excessive surface temperatures when using conventional heating methods, such changes in thermal processing would result in an increased production cost and therefore do not offer a practical solution to the problem.

In accordance with the present invention, electromagnetic energy is used to obtain a heat treated carbonaceous shape, such as formcoke, having the desired mechanical strength, resistance to surface abrasion, and chemical reactivity by minimizing the formation of cracks and pores, promoting a substantially uniform microstructure from the surface to the center of the carbonaceous shape, and controlling the degree of graphitization. More particularly, the invention utilizes induction heating or microwave heating or a combination of both to achieve the desired results.

FIG. 1 of the drawing is a schematic illustration of the steps involved in a typical procedure for making green formcoke briquettes.

FIG. 2 is a schematic illustration of the induction heating step of the present invention, which may be performed in a batch or continuous manner.

FIG. 3 is a schematic illustration of the microwave heating step of the present invention, which may be performed in a batch or continuous manner.

Figure 4:
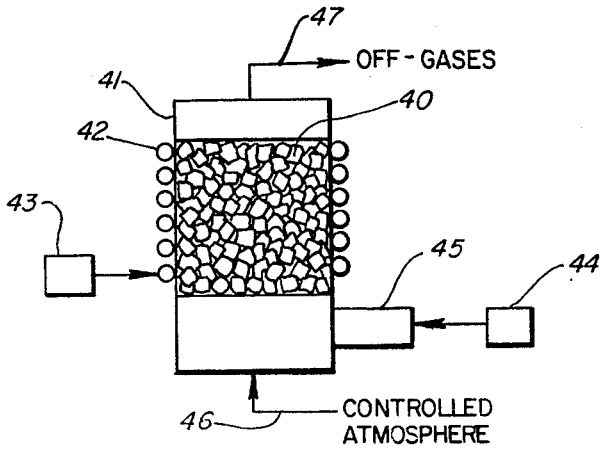
FIG. 4 is a schematic illustration of a preferred embodiment of the invention utilizing a combination of induction heating and microwave heating steps, which may be performed in a batch or continuous manner.

For effective induction heating, the green carbonaceous shapes must have adequate electrical conductivity. In cases where the green shapes possess reasonable conductivity, e.g., when the binder content is relatively low, it is possible to heat the carbonaceous shapes solely by induction heating. Alternately, the electrical conductivity of the green carbonaceous shapes may be enhanced to the required extent by subjecting the green shapes to microwave radiation and/or by incorporating in the carbonaceous shapes suitable amounts of at least one electrically conductive additive which is not detrimental to the final use of the carbonaceous shapes, e.g., graphite or various metals or metal oxides such as iron or iron oxide. The additive materials may be incorporated at either selected or random locations within or on the surface of the carbonaceous shape so as to obtain selective concentration of induction heating currents in the carbonaceous shape and thereby localize the induction heating effect so as to control the microstructure and consequent physical and chemical properties.

Induction heating is highly controllable with respect to direction and magnitude of the thermal gradient produced in the carbonaceous shape as well as the maximum temperature attained. In general, the direction of the thermal gradient at any point within the carbonaceous shape is controlled by the penetration depth of the induced field, which is a function of the frequency of the applied field and coil geometry. For a given coil design and penetration depth, the temperature at any position within the carbonaceous shape is a function of the power input and frequency, the physical and thermal properties of the material, and the heating time. Control of the coil design, penetration depth, and power input and frequency, in conjunction with the ability to utilize induction heating in a pulsed or continuous mode and to change power input and frequency as the electrical properties of the carbonaceous shapes change during processing, result in a high degree of flexibility and control over the product quality which are unobtainable with conventional practices.

Although in induction heating there is no contact between the induction coil and the material being heated, eddy currents are induced in the material which result in the desired heating effect. The frequency of the power source may range from about 60 to about 100,000 Hz. At high frequencies, however, the depth of penetration is less and the induced current tends to concentrate at the surface of the carbonaceous shape. The required heating time using either induction heating or microwave heating will be substantially less than using conventional heating methods. Effective induction heating of green formcoke briquettes may be obtained, for example, using a power source of 1000 watts at 2000 Hz for a period of from about 5 seconds to about 2 minutes. Short heating cycles, with either microwave or induction heating, are made possible by utilization of the energy input directly within the carbonaceous shapes. Since the normally refractory walls of the containment vessel or cavity are unaffected and absorb only minor energy quantities, the process is more efficient than conventional processes.

Microwave energy causes the molecular alignment of the material being heated to change rapidly at very high frequencies, thereby generating heat within the material itself. Thus, uniform heating throughout the material is obtained at precisely controlled temperatures since the heating is not dependent entirely upon the thermal conductivity of the material. Moreover, the material being heated need not be electrically conductive, as in the case of induction heating, but must have a polar molecular structure so as to absorb microwave radiation. Carbonaceous shapes can be formulated to be particularly good absorbers of microwave energy. Any conventional source of microwave energy may be used, including power-grid tubes, linear-beam tubes (such as a klystron), and cross-field devices (such as magnetrons and amplitrons). The microwave energy is transmitted by a suitable waveguide to the vessel containing the carbonaceous shapes to be heated. The design of the vessel may be selected so that the vessel functions as a resonant cavity operating in a desired resonant mode. The frequency of the microwave energy may range from about 25 to about 8350 MHz. Effective results may be obtained, for example, with a 1000 watt microwave source at a frequency of 2450 MHz for a heating time of from about 30 seconds to about 90 minutes. The microwave heating effect may also be enhanced by incorporating in the carbonaceous shape at least one additive material capable of concentrating microwave energy, such as those discussed above in connection with induction heating, to achieve selective concentration of microwave energy and thereby control the microstructure and consequent physical and chemical properties.

Referring to FIG. 1 of the drawing, a schematic flow sheet of a conventional formcoke process is shown. Pulverized coal is introduced to a fluidized vessel 10 wherein drying and oxidation of the coal is accomplished by means of steam and air. The resultant product is then introduced to a carbonizer 11 where combustion of a portion of the coal is effected to obtain a relatively low carbonizing temperature of from about 460° C. (860° F.) to about 540° C. (1000° F.) so as to remove volatile matter, including tar. The carbonized product or char is introduced into a calciner 12 where the char is heated to obtain a substantially higher temperature of from about 760° C. (1400° F.) to about 870° C. (1600° F.) The resultant calcined char is mixed with a suitable binder, such as the coal tar removed in the carbonizer 11, and the mixture is fed to a roll press 13 or other suitable compacting apparatus to form the green briquettes. The amount of binder used will depend on a number of factors, but, as an example, for hot compaction of a calcined char-coal tar mixture, the binder content of the green briquettes may be from 10 to about 15 wt.%. In the conventional formcoke process, the green briquettes are then cured and coked using conventional thermal heating methods.

FIG. 2 is a schematic illustration of the induction heating of the green formcoke briquettes in accordance with one aspect of the present invention. Although a continuous mode of operation may be employed in which briquettes may be heated individually, FIG. 2 shows a batch operation in which the green briquettes 20 are contained in a suitable vessel 21 surrounded by an induction heating coil 22. A power source 23 at a suitable frequency, e.g., a power source of 1000 watts at 2000 Hz, is connected to the heating coil 22. A controlled atmosphere, either oxidizing or non-oxidizing, as desired, is introduced through an inlet conduit 24, and off-gases are removed through an outlet conduit 25. Depending on the amount and nature of the atmosphere introduced, the off-gases may comprise a valuable by-product gas of relatively high heating value, particularly where the organic binder content of the green briquettes is high.

FIG. 3 is schematic illustration of a heating operation using microwave energy in accordance with another aspect of the present invention. Although continuous operation may also be employed, FIG. 3 shows a batch operation in which the green formcoke briquettes 30 are contained in a vessel 31. A microwave energy source or power input 32 operating at a suitable frequency, e.g., a power source of 1000 watts at 2450 MHz, supplies microwave energy to the vessel 31 through a waveguide 33. A controlled atmosphere is introduced at the bottom of the vessel 31 through a conduit 34, and off-gases are removed from the top of the vessel through an outlet conduit 35.

FIG. 4 illustrates a preferred embodiment of the invention wherein the heating of the green briquettes is accomplished by a combination of microwave heating and induction heating, and for purposes of illustration, a batch operation is shown. In this case, the charge of green briquettes 40 is contained in a vessel 41 which is equipped with an induction coil 42 connected to a power source indicated at 43. The vessel 41 is also heated by microwave energy supplied by a power input 44 connected to the vessel 41 through a waveguide 45. The vessel 41 is also provided with an inlet conduit 46 for introducing a controlled atmosphere and an outlet conduit 47 for the removal of off-gases. In some cases the binder content of the green briquettes results in a low electrical conductivity which precludes effective use of induction heating alone. Accordingly, suitable circuitry (not shown) is provided to permit switching between the microwave heating mode and the induction heating mode. Preferably, the initial portion of the heating step is accomplished by the use of microwave heating alone, whereby to effect devolatilization and removal of the binder and other volatilizable materials in a curing step. Following this step, the use of microwave energy is terminated, and the induction heating is initiated to complete the heat treating operation. Typically, the curing step using microwave heating may be carried out using an oxidizing atmosphere, and the final coking step using induction heating alone may be carried out using a non-oxidizing atmosphere. Thus, by sequential use of microwave heating and induction heating, a rapid and highly efficient formcoking operation is provided.

Figure 5:
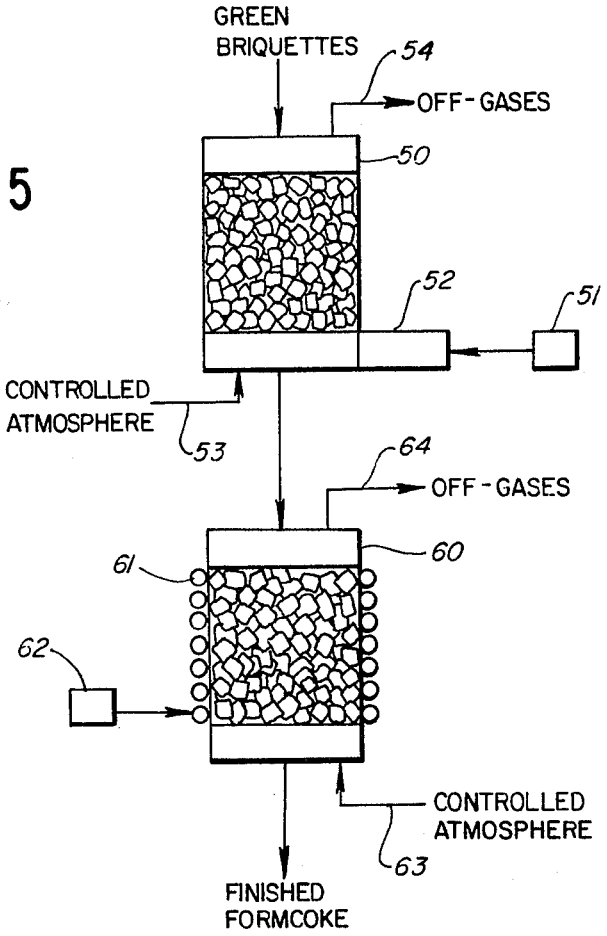
FIG. 5 is a schematic illustration of a modification of the process of FIG. 4, wherein the induction heating and the microwave heating steps are conducted in separate vessels, and may be performed in a batch or continuous manner.

Although in FIG. 4 the sequential microwave heating and induction heating process is carried out in situ using a single vessel, it is also possible to accomplish the same result using separate vessels. Thus, in FIG. 5, the green briquettes are first introduced into a vessel 50 in which microwave heating is accomplished by a power input 51 connected to a waveguide 52 communicating with the vessel 50. A controlled atmosphere, typically an oxidizing atmosphere, is introduced through an inlet conduit 53, and off-gases containing the volatilized binder are removed through an outlet conduit 54. The partially cured green briquettes are removed from the vessel 50, either batchwise or continuously, and introduced to a separate vessel 60 equipped with an induction heating coil 61 which is energized from a power input source 62. A controlled non-oxidizing atmosphere is introduced to the vessel 60 through a line 63, and off-gases are removed through an outlet conduit 64. The finished formcoke is then discharged from the vessel 60.

As described above, additives may be incorporated in the green carbonaceous shapes for the purpose of enhancing or concentrating the heating effect by induction or microwave heating and thereby controlling the microstructure and consequent physical and chemical properties. However, other additive materials may also be included to provide a desired chemical or physical effect. For example, additives may be used which offer only marginal benefits in the concentration of induction currents or microwave energy but which will provide a beneficial interaction, e.g., by fluxing or slagging, with certain constituents of the carbonaceous shapes. In this way, it is possible to render inert certain impurities, such as silica, sulphur, alkali ingredients, etc., that could otherwise be harmful in subsequent metallurgical processes in which the carbonaceous shape is to be used or that would be harmful in other end uses of the carbonaceous shape.

The invention also contemplates alteration of the frequency of the energy source during either induction heating or microwave heating. For example, as previously noted, induction heating at higher frequencies tends to concentrate the heating effect at the surface of the carbonaceous shape. It is possible, therefore, to achieve a highly desirable result by carrying out the initial portion of the induction heating at a relatively lower frequency, which will effect substantially uniform heating throughout the carbonaceous shape, and thereafter increasing the frequency to a relatively higher level whereby to effect selective surface graphitization of the carbonaceous shape. By this sequence, it is possible to obtain an optimum combination of structural strength, abrasion resistance, and chemical reactivity in formcoke or other carbonaceous shapes. As is well understood, the selected frequencies will vary dependent upon the depth of current penetration and the resistivity of the carbonaceous shape. Also, by incorporating an electrically conductive additive material at selected internal locations within the carbonaceous shapes, the resultant localized induction heating causes selective graphitization within the interior portions of the shapes instead of on the surface.

In summary, the use of induction heating or microwave heating in accordance with the present invention offers the following advantages:

(1) The total time for heating the green carbonaceous shapes is markedly reduced compared with conventional heating methods.

(2) Both induction heating and microwave heating are more efficient than conventional thermal heating methods.

(3) Because the carbonaceous shapes are initially heated more uniformly than in conventional processes, better control of the properties of the carbonaceous shapes is realized.

(4) The process can be operated to provide a high heating value off-gas that is readily recoverable in relatively uncontaminated form.

Although the invention has been described with particular reference to certain specific embodiments, it will be understood that various modifications and alternatives, including the production of a variety of carbonaceous shapes, may be resorted to without departing from the scope of the invention as defined in the appended claims.

We claim:

1. A process for producing compacted carbonaceous shapes comprising the steps of mixing a particulate carbonaceous material with a volatilizable organic binder, said particulate carbonaceous material comprising a calcined char obtained by carbonizing pulverized coal to remove volatile matter and calcining the resultant char, forming the mixture into preformed green shapes, heating said green shapes initially by induction heating at a relatively lower frequency so as to effect substantially uniform heating throughout said shapes, and thereafter heating said shapes by induction heating at a relatively higher frequency sufficient to effect increased heating at the surfaces of said shapes whereby to effect surface graphitization of said shapes.

2. A process for producing compacted carbonaceous shapes comprising the steps of mixing a particulate carbonaceous material with a volatilizable organic binder, said particulate carbonaceous material comprising a calcined char obtained by carbonizing pulverized coal to remove volatile matter and calcining the resultant char, forming the mixture into preformed green shapes, heating said green shapes initially by microwave heating to remove the binder and other volatilizable components until an adequate electrical conductivity is obtained to permit induction heating of said green shapes, and thereafter heating said green shapes by induction heating.

3. The process of claims 1 or 2 wherein an electrically conductive additive material is incorporated in said green shapes to enhance the induction heating effect.

4. The process of claims 1 or 2 wherein said induction heating is effected by means of a power source having a frequency of from about 60 to about 100,000 Hz.

5. The process of claim 2 wherein an additive material capable of concentrating microwave energy is incorporated in said green shapes to enhance the microwave heating effect.

6. The process of claim 2 wherein said microwave heating is effected by means of a power source having a frequency of from about 25 to about 8350 MHz.

7. The process of claims 1 or 2 wherein an additive material is incorporated in said green shapes which is capable of chemically reacting with impurities in said green shapes during heating.

8. The process of claim 1 wherein said green shapes are contained in a heating vessel, a controlled gaseous atmosphere is passed through said vessel during the heating step, and an off-gas of substantial heating value is removed from said vessel.

9. The process of claim 2 wherein an oxidizing atmosphere is passed through said green shapes during the initial microwave heating and a non-oxidizing atmosphere is passed through said green shapes during the final induction heating.

10. The process of claim 2 wherein said green shapes are contained in a single vessel and are heated in situ, first by microwave heating and thereafter by induction heating.

11. The process of claim 2 wherein said green shapes are heated in a first vessel by microwave heating and are then passed to a second vessel where they are heated by induction heating.

12. A compacted carbonaceous shape made in accordance with the process of claim 1.

13. A compacted carbonaceous shape made in accordance with the process of claim 1 and having a graphitized surface.

14. The process of claims 1 or 2 wherein said binder comprises coal tar or pitch.

15. The process of claims 1 or 2 wherein the binder content of said green shapes is at least about 10 wt.%.

16. The process of claims 1 or 2 wherein said binder comprises coal tar recovered from said carbonizing step.

* * * * *